US006104376A

United States Patent [19]

Chang

[11] Patent Number: 6,104,376

[45] Date of Patent: Aug. 15, 2000

[54] EQUIPMENT FOR OUTPUTTING VIDEO IMAGES TO A COMPUTER SCREEN

[75] Inventor: Tsung-Hsing Chang, Tu-Cheng, Taiwan

[73] Assignee: Leadtek Research Inc., Taipei Hsien, Taiwan

[21] Appl. No.: 09/000,960

[22] Filed: Dec. 30, 1997

[30] Foreign Application Priority Data

Nov. 10, 1997 [TW] Taiwan ..... 86116728

[51] Int. Cl.[7] ..... G09G 5/02

[52] U.S. Cl. ..... 345/150; 345/132

[58] Field of Search ..... 345/150, 151, 345/152, 153, 154, 155, 1, 2, 3, 115, 132; 348/447, 448

[56] References Cited

U.S. PATENT DOCUMENTS 4,916,541 4/1990 Hashimoto et al. ..... 348/448

5,097,257 3/1992 Clough et al. ..... 345/132

5,182,643 1/1993 Futscher ..... 348/447

*Primary Examiner*—Xiao Wu

*Attorney, Agent, or Firm*—Jiawei Huang; J.C. Patents

[57] ABSTRACT

A video communicating equipment that receives digital image data and a clock signal as input, generating analogue image data internally and then outputting the analogue image data to a computer screen. The video communicating equipment comprises a line buffer, a complex programming logic device and a digital-to-analogue converter. Using only a normal telephone network and an ordinary computer screen, the video communication equipment of this invention enables both voice and video communication functions. Furthermore, the computer screen can be selected to output either computer images or video communication images.

13 Claims, 1 Drawing Sheet

EQUIPMENT FOR OUTPUTTING VIDEO IMAGES TO A COMPUTER SCREEN

CROSS-REFERENCE TO RELATED APPLICATION

This application claims the priority benefit of Taiwan application Ser. No. 86116728, filed Nov. 10, 1997, the full disclosure of which is incorporated herein by reference.

BACKGROUND OF THE INVENTION

1. Field of Invention

The present invention relates to equipment for establishing video communication via a computer screen. More particularly, the present invention relates to equipment that utilizes the telephone network to output video images on a computer screen and achieves dynamic video and voice communication through a computer system.

2. Description of Related Art

In the past few decades, development in electronic technologies is so fast that people can now routinely communicate with each other through an electronic media. Recently, the communication media has gone a step forward by the development of video communication techniques and equipment. Besides being able to listen to the voice coming from the other party through a telephone network, somewhat dynamic video images can be transferred through a telephone line at the same time. An example is the video teleconferencing system now widely used in a business environment. Hence, communication is going to be more life-like when the same kind of systems can be use at home using a personal computer.

FIG. 1 is a block diagram showing a conventional method for generating digital image. As shown in FIG. 1, the transmission of conventional video signals involves a camera 10. The camera 10 records an image, and then the image is passed to a microprocessor 12 where the image is converted into data with a specified digitized format. For example, the format Y:U:V=4:2:2 originated by the company AMD is now commonly used to represent digital image data Ddig. Next, the digital image data Ddig are output to the receiving side. On receiving the digital image data Ddig, the image is reproduced and displayed in a television screen. Since the output video data is suitable for television only, it is difficult to be displayed on a computer screen.

In light of the foregoing, there is a need for widening the useful range for the digital image data.

SUMMARY OF THE INVENTION

Accordingly, the present invention is to provide video communication equipment that can be used for broadcasting video image through a computer screen. Through such video communication equipment, therefore, digital image can be brought out in a computer screen facilitating the computer users. Furthermore, the quality of image displayed on a computer screen is definitely going to be higher than on an ordinary television, especially in a multimedia computer environment.

To achieve these and other advantages and in accordance with the purpose of the invention, as embodied and broadly described herein, the invention provides video communication equipment for generating images on a computer screen. The video communication equipment receives digital image data and then generating an analog image output for display by the computer screen. The video communication equipment includes a data bus, a line buffer, a complex programming logic device, a digital-to-analogue converter, and a multiplexer. The data bus is for transmitting digital image data. The line buffer receives the digital image data, generates and then outputs twice the number of raster image data lines. The complex programming logic device receives the digital image data and then outputs control signals to the line buffer for synchronizing the horizontal and vertical scanning action on a computer screen. The digital-to-analogue converter receives the doubled raster image data lines and then converts it to analogue image data. The multiplexer receives the analogue data and a multiplexer control signal, and under the control of the multiplexer control signal, the analogue image data are output to the computer screen. Hence, the video communication equipment can be selected to output either computer images or video communication images.

In another aspect, the invention provides video communication equipment for generating images on a computer screen. The video communication equipment receives digital image data and a clock signal, and then generating an analog image output for display on the computer screen. The video communication equipment includes a line buffer, a complex programming logic device and a digital-to-analogue converter. The line buffer receives the digital image data, generates and then outputs twice the number of raster image data lines. The complex programming logic device receives the digital image data and then outputs control signals to the line buffer for synchronizing the horizontal and vertical scanning action in a computer screen. The digital-to-analogue converter receives the doubled raster image data lines, converts it to analogue image data, and then outputs to the computer screen. Hence, using a general telephone network, a computer screen and these video communication equipment, both video and voice communication functions are achieved.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
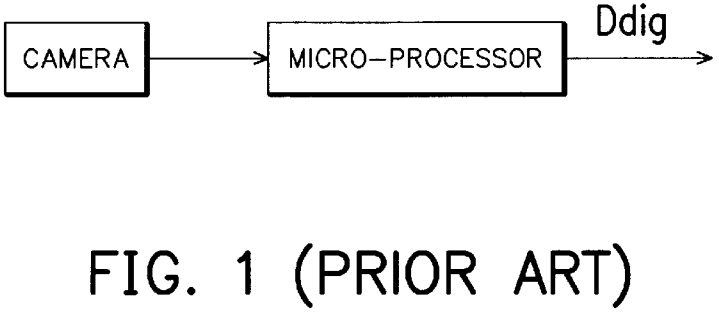
FIG. 1 (PRIOR ART)
FIG. 1 is a block diagram showing a conventional method for generating digital image.
Figure 2:
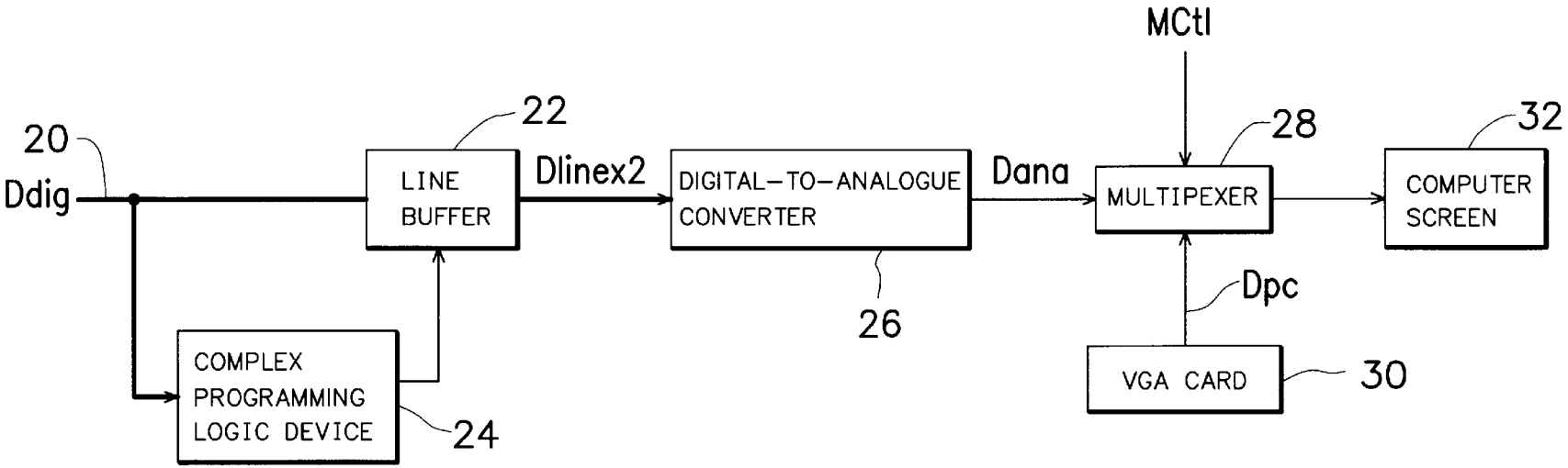
FIG. 2 is a block diagram showing video communication equipment for generating images in a computer screen according to one preferred embodiment of this invention.

Reference will now be made in detail to the present preferred embodiments of the invention, examples of which are illustrated in the accompanying drawings. Wherever possible, the same reference numbers are used in the drawings and the description to refer to the same or like parts FIG. 2 is a block diagram showing video communication equipment for generating images in a computer screen according to one preferred embodiment of this invention. As shown in FIG. 2, original digital image data Ddig having a video communication format of Y:U:V=4:2:2 and a clock signal CLK is sent to a line buffer 22 and a complex programming logic device 24 via a data bus 20. The digital image data Ddig sent to the line buffer 22 through the data bus 20 is a single line of image. The complex programming logic device 24 is used for processing the digital image data Ddig such that control signals for synchronizing the horizontal and vertical scanning motion of a computer screen and clock signals are generated. In here, the line data buffer 22 receives line data in the video format, and together with the timing signals produced by the complex programming logic device 24, the line data is converted into useful data necessary for the operation of the computer screen.

The original image is composed of interlaced odd and even data lines. In this invention, the digital image data Ddig is repeatedly displayed on the odd and even part of a computer screen. An ordinary television screen normally employed just 400 interlaced lines. Since the computer screen has a rather high resolution, for example, 640×480, 800×600, 1024×768, 1152×864 and so on, and working in a non-interlaced mode, it is much better than an ordinary television screen. Therefore, the method used in this invention will not affect the displayed quality of the image.

As shown in FIG. 2, the even line number data Dlinex2 is then sent from the line buffer 22 via another data bus to a digital-to-analogue converter 26. There, the digital image data is converted into analogue image data Dana, and then sent out to a multiplexer 28. For example, the digital image data in a YUV format is converted into analogue image data in a RGB (Red, Green and Blue) format suitable for computer display. The multiplexer 28 receive analogue image data Dana from the digital-to-analogue converter 26 besides receiving computer image data Dpc from the VGA card of a computer. Under the control of a multiplexer control signal MCt1, selection can be made either to output the data Dana coming from the digital-to-analogue converter 26 or to output the image data Dpc coming from the computer to a computer screen 32. A simple switch can be used to implement the selection function. Therefore, computer users can have a choice in selecting the output on a computer screen, thus enriching their video-communicating environment.

Consequently, using a normal telephone network and an ordinary computer screen, the video communication equipment of this invention can enable both voice and video communication. Secondly, the computer screen can be selected to output either computer images or video communication images.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A video communicating equipment receiving digital image data input and generating analogue image data output to a computer screen, comprising:

a data bus for transmitting the digital image data;

a complex programming logic device for receiving the digital image data, generating control signals for synchronizing the horizontal and vertical motion of the scan lines, and then outputting the control signals;

a line buffer, responsive to the complex programming logic device, for receiving the control signals and the digital image data and then generating and outputting twice the number of raster image data lines under the control of the control signals;

a digital-to-analogue converter for receiving the doubled raster image data lines and then converting into analogue image data; and a multiplexer for receiving the analogue image data and a multiplexer control signal, wherein under the controlling action of the control signal, the analogue image data is sent to the computer screen.

2. The equipment in claim 1, wherein the data bus also includes to function of transmitting a clock signal.

3. The equipment of claim 1, wherein the multiplexer control signal is used for selecting the output of analogue image data or computer image data.

4. The video communicating equipment of claim 1, comprising only one said line buffer.

5. A video communicating equipment receiving digital image data input and generating analogue image data output to a computer screen, comprising:

a data bus for transmitting digital image data;

a complex programming logic device for receiving the digital image data, generating control signals for synchronizing the horizontal and vertical motion of the scan lines, and then outputting the control signals;

a line buffer, responsive to the complex programming logic device, for receiving the control signals and the digital image data and generating and outputting twice the number of raster image data lines under the control of the control signals: and a digital-to-analogue converter for receiving the doubled raster image data lines, converting into analogue image data; and outputting to a computer screen.

6. The equipment of claim 5, wherein the computer image data comes from a VGA card of a computer.

7. The equipment of claim 5, wherein the analogue image data are red, blue, green image data.

8. The video communicating equipment of claim 5, comprising only one said line buffer.

9. A video communicating equipment receiving digital image data and a clock signal as input, and generating analogue image data output to a computer screen, comprising:

a complex programming logic device for receiving the digital image data, generating control signals for synchronizing the horizontal and vertical motion of the scan lines, and then outputting the control signals;

a line buffer, responsive to the complex programming logic device, for receiving the control signals and the digital image data and generating and outputting twice the number of raster image data lines under the control of the control signals; and a digital-to-analogue converter for receiving the doubled raster image data lines, converting into analogue image data; and outputting to a computer screen.

10. The equipment of claim 9, wherein the equipment further includes a multiplexer for receiving a multiplexer control signal, the analogue image data and a computer image data, and the multiplexer control signal is used for controlling the output of either the analogue image data or the computer image data from the multiplexer.

11. The equipment of claim 10, wherein the computer image data comes from a VGA card of a computer.

12. The equipment of claim 9, wherein the analogue image data are red, blue, green image data.

13. The video communicating equipment of claim 9, comprising only one said line buffer.

* * * * *